US005462391A

United States Patent [19]

Castle et al.

[11] Patent Number: 5,462,391

[45] Date of Patent: Oct. 31, 1995

[54] MINE ROOF SUPPORT CRIBBING SYSTEM

[75] Inventors: Brian R. Castle; James J. Scott, both of Rolla, Mo.

[73] Assignee: Scott Investment Partners, Rolla, Mo.

[21] Appl. No.: 185,262

[22] Filed: Jan. 24, 1994

[51] Int. Cl.[6] ..... E21D 21/00; E21D 20/02

[52] U.S. Cl. ..... 405/302.2; 405/259.1; 405/288

[58] Field of Search ..... 405/259.1, 288, 405/302.2, 302.3

[56] References Cited

U.S. PATENT DOCUMENTS

| | | | |
|---|---|---|---|
| 3,163,012 | 12/1964 | Dempsey | 405/302.2 |
| 3,389,561 | 6/1968 | Taylor . | |
| 3,427,811 | 2/1969 | White . | |
| 3,505,824 | 4/1970 | White . | |
| 3,509,726 | 5/1970 | White . | |
| 4,120,164 | 10/1978 | Tomlin | 405/289 |
| 4,265,571 | 5/1981 | Scott | 405/259 |
| 4,349,300 | 9/1982 | Kelley | 405/288 |
| 4,395,161 | 7/1983 | Wilson et al. | 405/288 X |
| 4,630,974 | 12/1986 | Sherman | 405/288 |
| 4,775,266 | 10/1988 | Seegmiller | 405/302.2 X |
| 4,776,729 | 10/1988 | Seegmiller | 405/288 |
| 4,946,315 | 8/1990 | Chugh et al. | 405/288 |
| 5,018,907 | 5/1991 | Chugh et al. | 405/288 |
| 5,149,228 | 9/1992 | Pienaar et al. | 405/289 |
| 5,230,588 | 7/1993 | Gillespie | 405/259.6 |
| 5,253,960 | 10/1993 | Scott | 405/302.2 |

*Primary Examiner*—Dennis L. Taylor

*Attorney, Agent, or Firm*—Polster, Lieder, Woodruff & Lucchesi

[57] ABSTRACT

A cable bolt mine roof crib for support and stabilization of roof rocks employing a series of cable bolts and/or cable members through a cribbing frame for actively supporting the roof and area surrounding an underground opening. The support imposes a restraint on geologic movement of the roof by the placement of rock anchors on the ends of cables at depth through the rock mass. The anchor portions of the cable bolts are placed beyond the zone of failure that would normally take place around an underground opening. The roof crib provides a bearing area for the roof rock which limits deformation and offers support by suspension to maintain interlock of rock fragments of the roof of the underground opening. The strength and length of cable bolts can be adjusted to fit initial tectonic load conditions and subsequent loads placed upon the opening by adjacent mining. The roof rocks above the crib may be prestressed by tensioning of the individual cable members, by the placement of pump packs or timber lagging between the crib frame and the roof rocks which may be pressurized to preload the entire structure.

3 Claims, 5 Drawing Sheets

MINE ROOF SUPPORT CRIBBING SYSTEM

FIELD OF THE INVENTION

The invention is directed to a mine roof support cribbing system to develop an effective support means to respond to the geologic disturbances incurred as a result of creating an underground mine opening thereby stabilizing the forces of nature and those created during mining.

DESCRIPTION OF PRIOR ART

It is known that in the creation of underground passages, geologic forces are released which cause movement or strains in the earth surrounding the passage, and that strain is reflected by movements in the mass of the geologic material, especially in the roof of the passage. Falls of ground create a major hazard to men and equipment in these openings. Means for resisting the forces to re-establish a balance and to retard movement of geologic material around the underground opening have been used for years and take many different forms. All forms of support try to restrain movement in the geologic mass to limit the zone of expansion in the rock around the opening. It is important to support that rock either by placement of forces against the surface of the opening or by placing internally anchored interior rock reinforcement fixtures which will anchor at some depth or along their entire length and will operate in conjunction with a surface control plate.

This invention of a cable bolt crib is directed particularly to the reinforcement of mine openings where massive rock deformation is expected. This often occurs when longwall mining practices are used in soft ground materials, such as coal, potash, trona, salt, etc. Mining practice is such that entries must be driven over long distances parallel to each other to provide a travel means to reach the mining face, as well as to provide adequate ventilation, and conveyor entries. It is important that these openings be maintained in a safe condition over the entire life of the mining operation. For a support system to be successful, it must be capable of restraining the movement of the geologic material sufficiently to allow continuous use of the openings.

Past practice has dictated that support systems, such as roof bolts and wire mesh and/or trusses, are reinforced by the placement of timber cribs or posts which extend between the floor and the roof rocks of the mine opening. A single row of cribs, or perhaps double row of cribs, may be placed along the entire length of these entries. The cribbing material is normally of wood but may be some form of concrete block or doughnut shaped material stacked in the entry. Regardless, the purpose of the cribbing is to prevent closure of the mine opening. In some cases, cribbing may be squeezed several inches during the loading process as the ground moves. Heaving of the floor may cause cribs to buckle, causing loss of control of the roof rocks. The cribbing material placed in the entry limits the movement of equipment and severely restricts the flow of air. In gaseous mines, this can create a hazard due to gas pocket buildup in and around and behind cribs. Explosions of these gas pockets have been the major cause for mine catastrophies over the past few years.

For the aforementioned reasons, it is desirable that entries of this type have support systems which do not restrict the cross sectional area of the entry. Thus, timber cribs are one of the least desirable support systems from that standpoint. Industry has used mechanical bolts, fully grouted resin bolts, post tensioned resin bolts, point anchor resin bolts, specialty bolts, individual cable bolts, mesh, bars and posts as forms of support which do not restrict the entry greatly, but in some cases provide adequate reinforcement. Unfortunately, with the greater application of caving methods, particularly the use of longwall mining in coal, these support systems are often overwhelmed and the last resort of the operator is to build cribs in the entry which essentially limit its usefulness. Many patents are on file on various forms of roof bolts. Cable bolt patents seem to be limited, as evidenced by U.S. Pat. No. 5,230,589 of Jul. 27, 1993 which discloses a cable mine roof bolt, or U.S. Pat. No. 5,253,960 of Oct. 10, 1993 which discloses a cable bolt. U.S. Pat. No. 4,265,571 of Oct. 16, 1981 has disclosed a cable sling for stabilizing underground openings. What is desired is a high strength anchor that allows the placement of high strength roof supports at the roof surface, such devices being anchored in the interior rock mass and which do not restrict the entry opening for other uses.

SUMMARY OF THE INVENTION

It is, therefore, one of the principal objects of the invention to provide a criblike frame, fixed by or attached to cable reinforced anchors to form a support system of high capacity when placed against the roof of the mine opening.

It is a further object of the invention to provide special fittings to the crib frame to allow attachment of various strengths of cable bolt anchors which are anchored at various depths in the rock.

Another object of the invention is to provide a large bearing surface against the roof of the mine to allow transfer of forces in a uniform manner to restrain geologic movement and prevent roof failure.

Another object of the invention is to provide a pump pack mechanism which will allow the crib frame to be pressurized to transfer geologic loads uniformly to a depth in the geologic mass by tensioning of the cable anchor fixtures.

A further object of the invention is to allow some movement of the roof rock due to stretch in the cables and flexing of the crib frame member to allow generation of arching stresses through the rocks to make them more self supporting.

Another object of the invention is to use high strength single and multi-cable rock anchors in the boreholes to adjust the rock carrying capability of the cable fixtures to match the needed restraint in any particular geologic setting. More cables and bigger cables can be installed to increase load carrying capability.

Another object of the invention is to use cables for supporting the crib frame against the roof that are flexible so that rock anchors can be placed at distances away from the opening greater than seam height. These anchors will not have couplings in the hole as one would normally expect with long rod anchors. However, boreholes only need to be large enough to facilitate cable entry and turning to place anchors at great depth.

A further object of the invention is to provide an opportunity to use a variety of materials for the roof crib such as a steel rigid structure, a steel flexible structure, using such things as flat strap in conjunction with channels or angle around the edges or cables, and furthermore, screening, turnplates, and/or timber may be used as an integral part of the roof crib frame.

Another object of the invention is to allow post tensioning of cable bolts to prestress the roof rocks under the timber crib after it is in place by hydraulically jacking to load cable members.

Another object is to provide a method for prestressing by the use of a pump pack and adjusting the interior pressure of the cement or hardening agent in the pump pack to fit the preload desired.

These and other objects of the invention will be set forth in details of the construction as seen in several views of the drawings.

BRIEF DESCRIPTION OF THE DRAWINGS

The preferred embodiment of the improvement is illustrated in which.

DETAILED DESCRIPTION OF THE EMBODIMENTS

Figure 1:
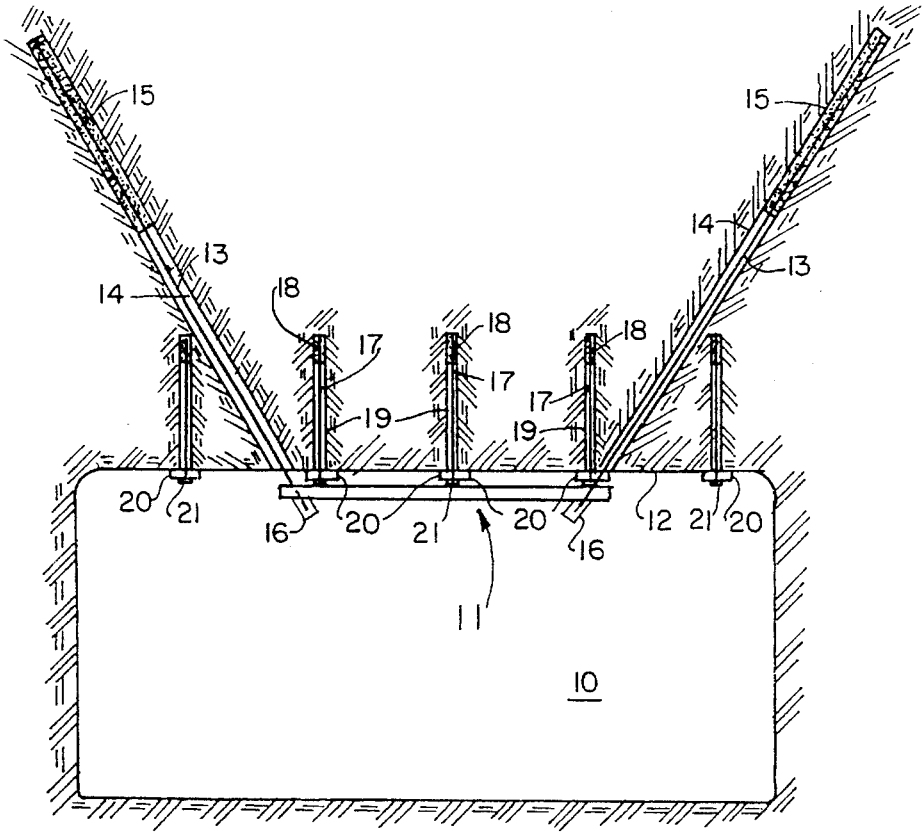
FIG. 1 is a schematic view in cross section of a mine entry with a cable bolt roof crib supported in place against the roof rock at or near the center line of the entry, the crib being held in place by long cable bolts anchored above the entry edges in the compression zone of the pillar.

The best mode for practicing mine roof support cribbing systems is first shown in FIG. 1 where there is a schematic cross section of a mine entry 10 in which a crib body 11 is supported against the roof rock mass 12. The crib body is secured by laterally angled elongated cable bolts 13 anchored in boreholes 14 by the insertion of cartridges of resin anchor material 15 near the back end of the borehole 14. The exposed ends 16 of these cable bolts 13 are secured in the crib 11 by suitable fasteners 16 of a character seen in Scott U.S. Pat. No. 5,253,960. In addition, the roof rock is additionally supported by a system of individual anchor rods 17 having ends secured in a body of resin 18 in the back of the shorter boreholes 19. Each of the rods 17 has its end engaged in suitable roof plates 20 in combination with formed heads or nuts 21. An example of anchor rods and roof plates is seen in Rozanc U.S. Pat. No. 4,564,315.

Figure 2:
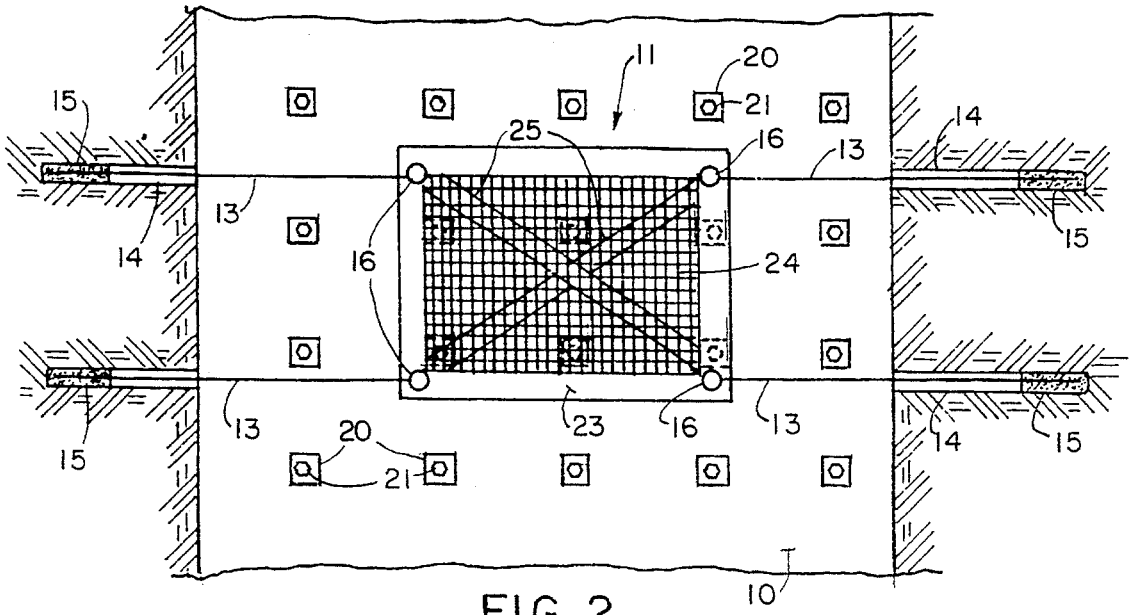
FIG. 2 is a schematic view looking upward at the roof from below a cable bolt crib in place, anchored at its four corners by cable bolts extending into the mine roof, and showing a pattern bolt support system.

The view of FIG. 2 is taken looking up at the crib body 11 held centrally in the entry 10 by the cable bolts 13. The exposed ends of the cable bolts 13 are connected, as noted above, in the crib 11 which is a frame structure 23 supporting a screen 24 adjacent the roof 12. The frame 23 includes cross braces 25 to further strengthen the frame. As before noted the roof 12 in the entry 10 is supported by a field of individual anchors 17 (see FIG. 1), whereby a substantial area of the roof 12 is stabilized. That field of anchors is represented in FIG. 2 by the plates 20.

Figure 3:
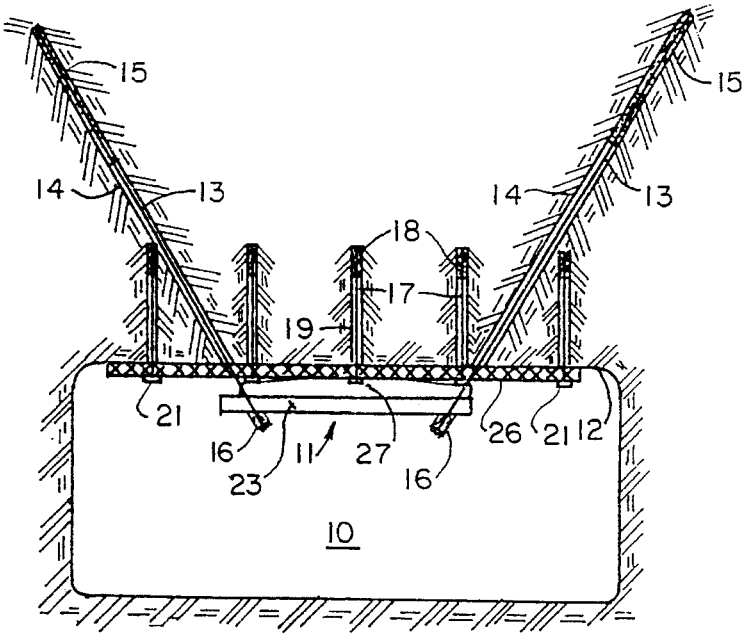
FIG. 3 is a schematic view in cross section showing a pump pack on a crib frame placed against a previously installed screening against the mine roof.

The view of FIG. 3 is similar to FIG. 1, the difference being that there is the screen 24 seen only in FIG. 2 that is carried in the frame 23, and the space between the screen and the roof 12 is utilized to receive a wire screen 26 held partly by a frame 11 on which has been placed a pump pack 27 for the purpose of being able to adjust the pressure exerted on the roof surface 12. The pump pack 27 is filled with various amounts of suitable cementitious material to exert a variable degree of pressure on the roof rock. The area of the roof has been stabilized by anchors 17 securing roof plates 20 and a nut 21.

Figure 4:
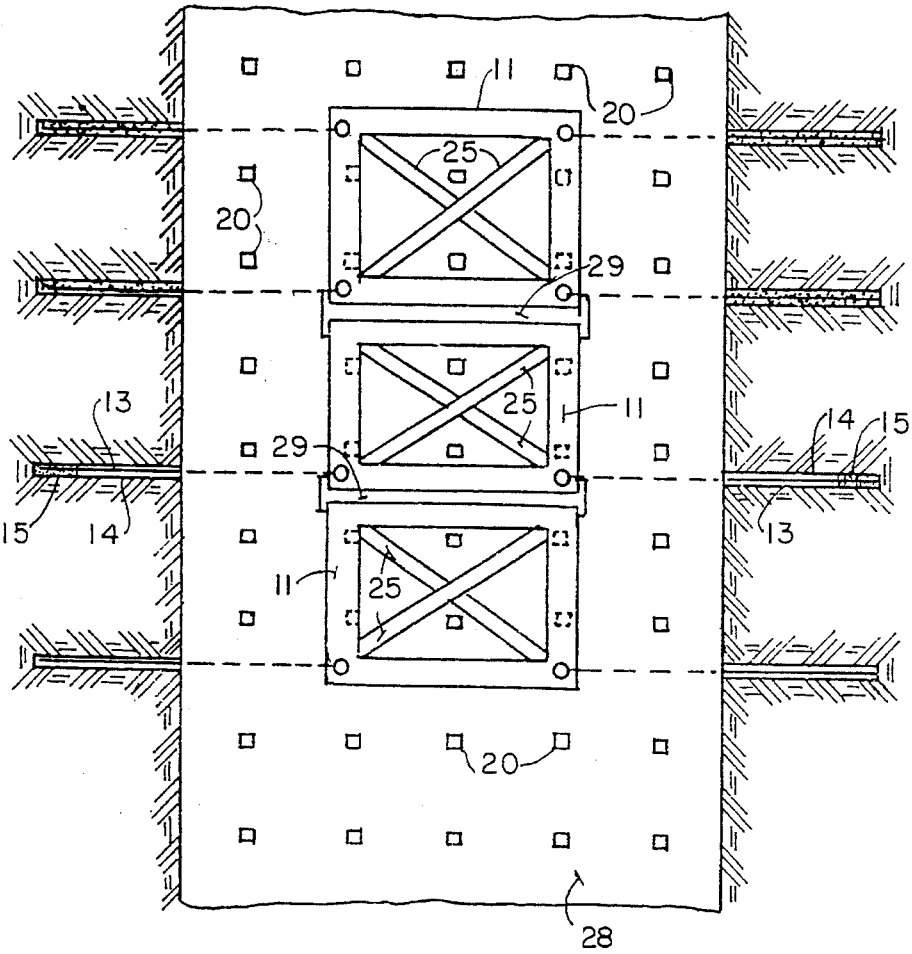
FIG. 4 is a schematic view looking upward at the roof of the mine passage where a series of cable bolt supported roof cribs are attached together in such manner to provide continuous support along the center line of the entry in combination with a pattern bolt support system.

The view of FIG. 4 takes in a view looking up at a part of a long wall opening 28 illustrating a system of supporting the roof surface by a continuous run of roof crib frames 11 interconnected by coupling devices 29. The devices are adapted to effect connection with crib frames 11 as more of such frames 11 are brought into the opening 28 to provide a progressive run of crib frames. As the crib frames are added, the mine roof is also stabilized by the installation of roof bolts 17 of the character shown in FIG. 1 which have plates 20 held by formed heads or nuts 21. The installation of the crib frames 11 requires the addition of the long cable bolts 13 in boreholes 14 which receive anchor cartridges containing resin anchor material 15.

Figure 5:
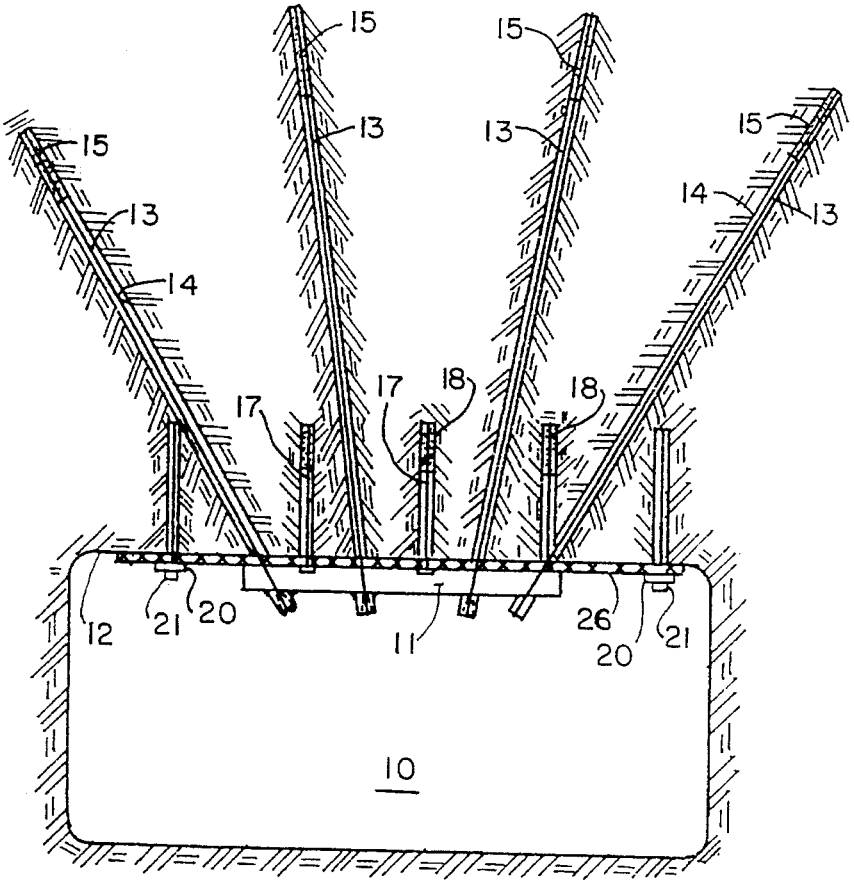
FIG. 5 is a cross section showing various lengths and strengths of fixtures which may be placed vertically as well as at an angle to reinforce the structure and fit localized, difficult geologic conditions.

A further embodiment of the invention is seen in FIG. 5 where the mine opening 10 is provided in the roof 12 with a screen 26 positioned against the roof and held in place by short roof bolts and a crib frame 11 through the installation of long bolts 13 angled outwardly in boreholes 14 and secured by resin material 15. Additional long bolts 13 can be inserted in boreholes 15 directed more vertically to reinforce the outwardly angled bolts 13. Again a field of shorter bolts 17 is established in boreholes 19 to retain roof plates 20. The long cable bolts 13 vary in depth of borehole penetration into the roof rock and can also vary in strength so as to be suitable for cooperating with the shorter length of the roof bolts 17.

Figure 6:
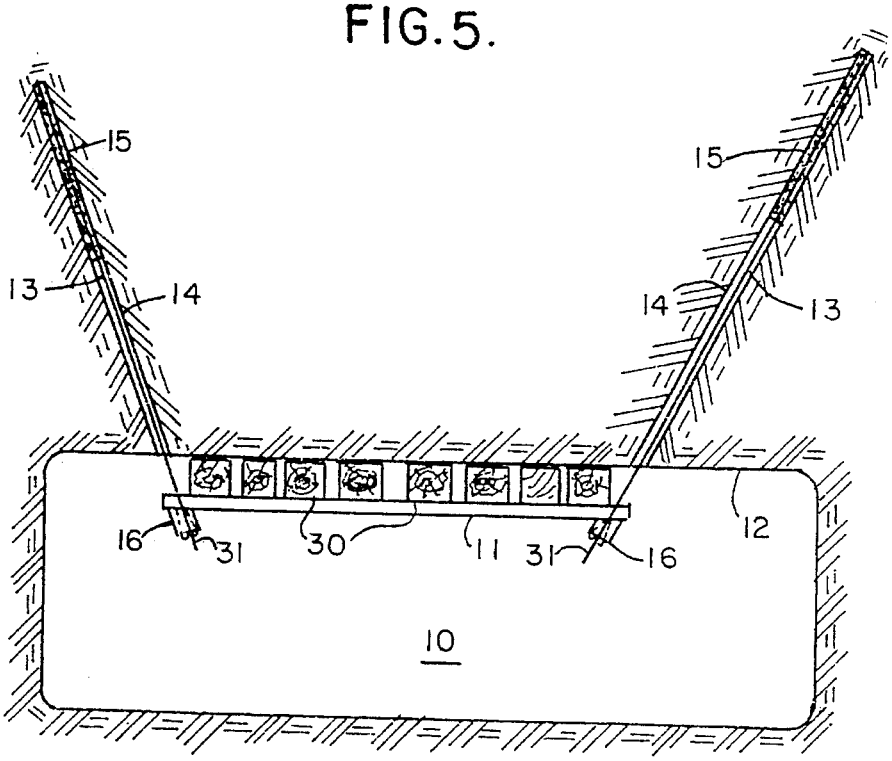
FIG. 6 is a cross section showing timber placed between the steel frame and the roof rock to bear against the roof and create a crib supported by cables having post tensioning features.

FIG. 6 shows a mine opening 10 in which the roof area 12 is supported by a crib frame 11 located to hold a collection of timbers 30 to support the roof. The frame 11 is secured in position by long cable bolts 13 in laterally angled boreholes 14 and anchored in resin material 15. The long cable bolts 13 have exposed ends 31 for being able to post tension the same to adjust the support of the timber 30. A post tensioning device of the character to be employed for the cables 13 is shown in a prior patent application of James J. Scott, Ser.

No. 08/122,537 filed Sep. 17, 1993. That post tensioning device is expressly adopted herein by reference to that earlier application. The post tensioning concept is also applicable to multi-cable bolts as referred to in the James J. Scott earlier application, Ser. No. 08/106,888, filed Aug. 16, 1993. As described further in applicant's earlier filed application Ser. No. 08/122,337, filed Sep. 17, 1993, a jacking device (seen in FIG. 1 of the earlier filed application) connected to the end 38A of cable 38 can impart its tension load on the cable for exerting a post tension load on the cable after the cable 38 has been installed for the purpose of establishing a desired post or later applied tension in the anchor cables 34 mounted in the bore holes 33.

Figure 7B:
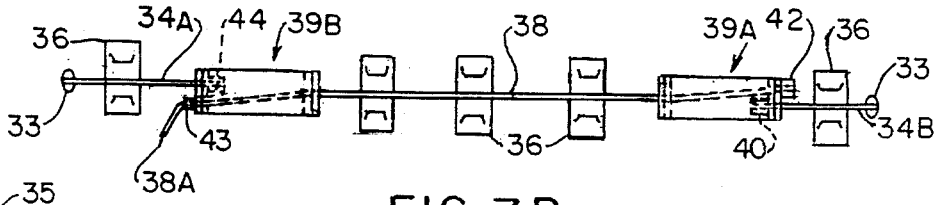
FIG. 7B is a cross section view taken along line 7B—7B in FIG. 7A.
Figure 7A:
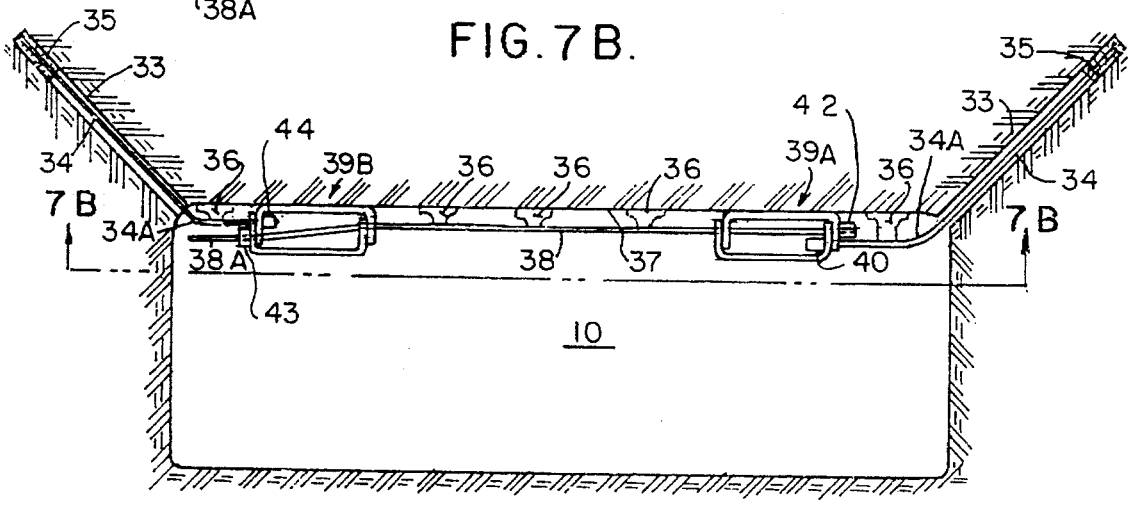
FIG. 7A is a cross section showing roof bolts which have been secured in a resin anchor material in angled boreholes in the roof rock and showing one of the cables on each side attached to a first splice plate and the respective splice plates are interconnected by a length of cable to complete the tie-in between the two anchor cables.

In FIGS. 7A and 7B there is shown a typical installation of a mine roof cribbing system utilizing cable bolt anchors 34 secured in boreholes 33 by resin material 35. Each cable bolt being elongated such that each has an end portion 34A which projects into the entry space 10. These end portions 34A are interconnected by cribbing means consisting of crib plates 36 held against the ceiling 37 by a length of cable 38 stretched between splice plates 39A and 39B. One splice plate 39A is connected to cable bolt end (at the right) 34A by a wedge nut 40. The opposite splice plate 39B is connected to cable bolt end 34A by a wedge nut 44. Thus, the cable 38 has one end secured in the splice plate 39A at a wedge nut 42. The opposite end of the cable 38 is secured in a wedge nut 43 positioned on the outside of the splice plate 39B. The splice plate 39B is connected to the end 34A of the cable bolt 34 in a wedge nut 44. The system of FIG. 7A or FIG. 7B is provided with an exposed end 38A by which tensioning means can be attached to adjust the tension load in the system.

Figure 8:
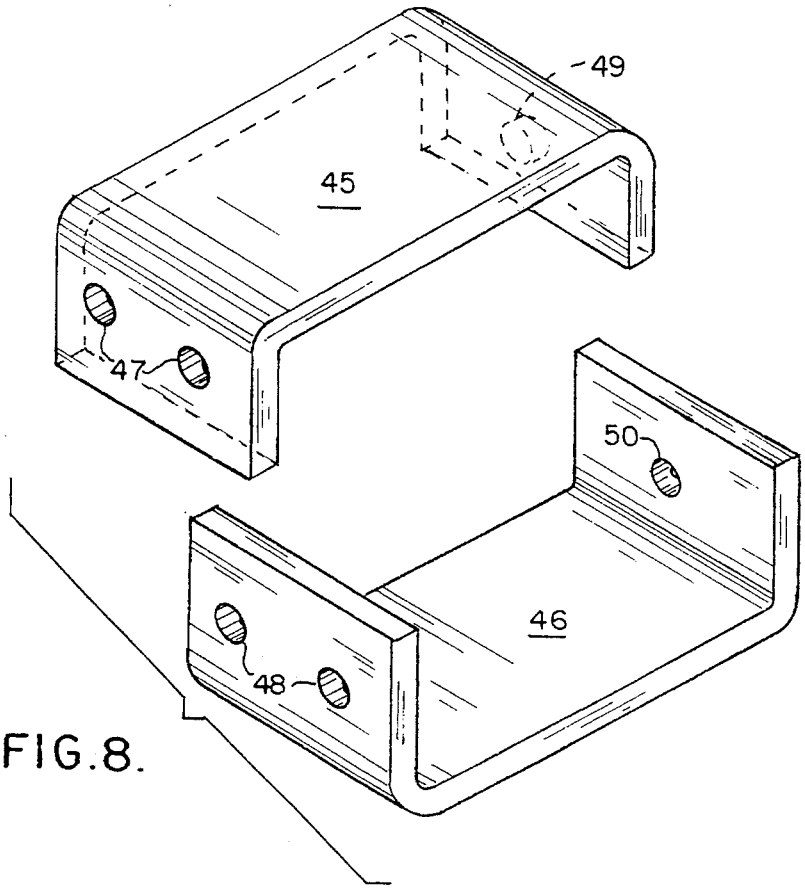
FIG. 8 is a perspective view of a pair of channel members which when in nested positions form splice plates.

An example of a splice plate 39A or 39B is seen in FIG. 8. There are a pair of channel shaped plates 45 and 46 which are adapted to nest so that a pair of apertures 47 align with matching apertures 48 and a single aperture 49 aligns with aperture 50. The splice plate 39 employs the pair of apertures 47–48 to enable the cable end 38A to be exposed in the manner of FIG. 7B, while being engaged to the cable 34A.

Figure 9:
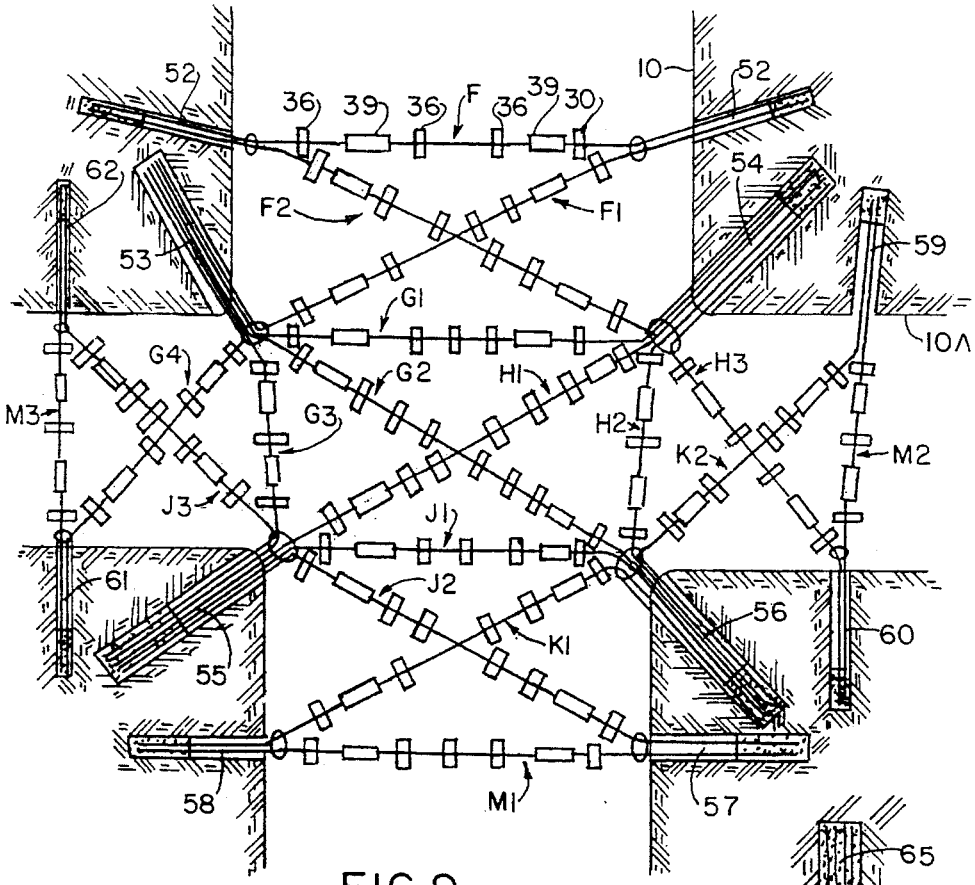
FIG. 9 is a plan view looking up at the area where underground mine openings intersect to show schematically the crib assembly for such an intersection.

A cribbing system embodiment is seen in FIG. 9 for the mine roof at an intersection of mine passages 10 and 10A. The description which follows is employing the shape of splice plates directed with the length dimension running parallel to the direction of the cables, and the shape of the crib plates which are directed perpendicular to the cables (using the example shown in FIG. 7B). Thus, looking upwardly at the ceiling of passage 10 there is a first crib assembly F having the lateral anchor cable bolts 52 supporting the crib F made up of crib plates 36 and splice plates 39. Each cable bolt 52 has a cable strand associated with the crib assembly F and another cable strand associated with the crib assemblies F-1 and F-2, each of which includes crib plates and splice plates similar to those referred to in crib assembly F.

Crib assembly F-1 is associated with an anchor cable bolt 53 which has five cable strands directed to form cable assemblies F-1, G-1, G-2, G-3 and G-4. Another anchor cable bolt 54 has its strands spread out so that one strand is assoicated with the aforementioned cable assembly F-2 and G-1, and other strands are directed to form cable assemblies H-1, H-2 and H-3.

The anchor cable bolt 53 is associated to cooperate with an anchor cable bolt 55 through a strand associated with cable assembly G-3 and cable assembly H-1 from the anchor cable bolt 54. In addition, the strands from the anchor cable bolt 55 form cable assemblies J-1, J-2 and J-3. In order to complete the crib assembly from anchor cable bolt 55 a fourth anchor cable bolt 56 has its strands directed to associate with the cable assemblies G-2, H-2 and J-1, as well as its strands are associated with cable assemblies K-1 and K-2. Other forms of cable bolt cribs as described above may be employed in three-way or angled intersections.

The mine passage 10 is formed with a ceiling crib assembly by means of anchor cable bolts 57 and 58 which cooperate with a strand from bolt 57 cooperating with crib assembly J-2 and with a crib assembly M-1 associated with a cable strand from bolt 58. In the same fashion the ceiling crib for the passage 10A employs anchor cable bolts 59 and 60 so that a strand from cable bolt 59 cooperates with a crib assembly K-2 from bolt 56, and with a common strand from bolt 60 to form a common crib assembly M-2. The bolt 60 has a strand associated with crib assembly H-3 from bolt 54. The final ceiling crib assembly for passage 10A is formed by anchor cable bolts 61 and 62 which form between them a crib assembly M-3, while bolt 61 has a strand cooperating with crib assembly G-4 from bolt 53, and bolt 62 has a strand to cooperate with crib assembly J-3 from bolt 55.

As pointed out in respect of the crib assembly F where the respective crib plates 36 and splice plates 39 have been identified, it is to be understood that each of the crib assemblies is composed of a number of crib plates and splice plates which are identified by the shape of those plates so as not to confuse the view of FIG. 9.

Figure 10:
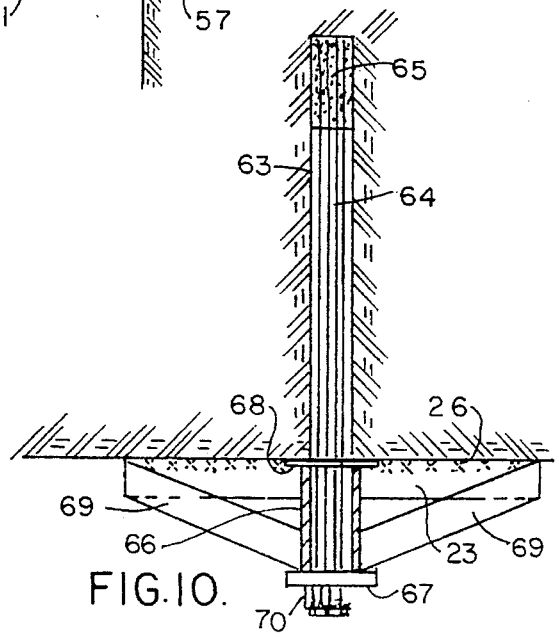
FIG. 10 is a cross section of a single borehole for a multi-cable bolt and a single crib frame shown supported against the ceiling roof rock.

In selected places, as illustrated in FIG. 10, a single crib frame structure 23 and a screen 26 can be positioned in association with a multi-cable bolt 64 secured in a borehole 63 by a resin body 65. The bolt emerges from the borehole 63 and is enclosed in a short length of tubing 66 held against the screen or ceiling adjacent the borehole by a compression plate 67 and a ceiling plate 68. The plate 67 supports bracing arms 69 which are welded or otherwise attached to the frame 23. When suitable attachments 70 are placed to receive the outer ends of the multi-cable, a tension means can be used to post tension the multi-cable roof bolt which sets the attachment to retain the tension in the multi-cable with the result that the crib frame is secured in position.

In a more complete understanding of the system there is a unique cooperation of components to effect mine roof support where underground passages intersect so that the passages enter into a common area from each of four directions. There results a complex arrangement of cribbing means installed in each of the four passages to be interconnected with a cribbing system for the common area. The complex cribbing means utilizes the system of crib plates 36 and splice plates seen in FIGS. 7A and 7B. The detail of the splice plate is seen in FIG. 8. What has been shown in FIGS. 7A and 7B and in FIG. 8 is a unique splice plate combination for interconnecting cable bolts 34 by splice plates 39A and 39B connected to the cable 38 stretched between the splice plates. What is evident from the several drawing views, and from the foregoing description of those drawing views, is that there has been no mention of the cooperating parts and elements being attached as shown in the drawings by the stringing of the roof bolt ends and the cable 38 through apertures in the nested splice plates. This is especially evident in FIGS. 7A and 7B which illustrate how the nested channel plates 45 and 46 are held in assembly as splice plates 39A and 39B.

The aim in the appended claims is to cover all changes and modifications that fall within the spirit and scope of the improvements disclosed herein.

What is claimed is:

1. A roof support cribbing system for underground mine openings into each of intersecting passages having pillars at each of four corners to define a common area with entries into the area from each of the intersecting passages, the cribbing system comprising:

(a) first cable anchor means installed in each of the passage openings to the common area, each first cable anchor presenting first and second cable strands projecting into the adjacent passage;

(b) multi-cable anchors, one positioned at each of the corner pillars and having a plurality of cable strands projecting into the common area; with certain of the cable strands directed into adjacent passages;

(c) roof support cribbing means interconnecting first cable strands directed across the individual passages to effect roof support in each of the passages approaching said common area; and (d) other roof support cribbing means interconnecting others of said plurality of cable strands from each of said multi-cable anchors at each of said corner pillars to form a composite roof support for the common area.

2. A mine roof supporting system for a mine passage in which cable roof bolts are secured in boreholes on opposite sides of the mine passage, said system comprising:

a) a splice plate positioned adjacent each of the boreholes, each splice plate having:

1. an elongated pair of channel plates with bent ends at the opposite ends of said channel plates for nesting thereof so the bent ends are in facing and lapped positions at opposite ends;

2. a pair of adjacent apertures opening through the lapped bent ends at one end of said pair of channel plates;

3. a single aperture opening through the lapped bent end of the opposite ends of said pair of channel plates;

b) an elongated cable extending between said splice plates with opposite ends extending through the single aperture openings and emerging through one of the pair of adjacent aperture openings;

c) each of said cable roof bolts having an end exposed in the mine passage in position to extend into the adjacent splice plate at the other one of said pair of adjacent apertures;

d) first wedge nuts securing said exposed ends of said cable roof bolts to said adjacent splice plates; and e) second wedge nuts securing the opposite end of said elongated cable to said splice plates.

3. The mine roof supporting system set forth in claim 2 wherein an emerging end of said elongated cable at one of said splice plates being in position for effecting post-tensioning of said cable bolts to adjust the support of the mine passage roof.

* * * * *